US005405099A

United States Patent [19]

Hehner et al.

[11] Patent Number: 5,405,099

[45] Date of Patent: Apr. 11, 1995

[54] WEB-SLITTING APPARATUS WITH DRIVEN PINCH AND WINDUP ROLLERS FOR VARYING WEB TENSION

[75] Inventors: Reinhard Hehner, Haan; Ernst-Gunther Urban, Neuss, both of Germany

[73] Assignee: Jagenberg Aktiengesellschaft, Dusseldorf, Germany

[21] Appl. No.: 778,873

[22] PCT Filed: Feb. 1, 1991

[86] PCT No.: PCT/EP91/00191

§ 371 Date: Dec. 23, 1991

§ 102(e) Date: Dec. 23, 1991

[87] PCT Pub. No.: WO91/16257

PCT Pub. Date: Oct. 31, 1991

[30] Foreign Application Priority Data

Apr. 24, 1990 [DE] Germany ..... 40 12 979.9

[51] Int. Cl.[6] ..... B65H 18/10; B65H 23/04

[52] U.S. Cl. ..... 242/530; 242/541.1; 242/542.3

[58] Field of Search ..... 242/56.2, 56.4, 56.5, 242/56 A, 65, 66, 56.9, 530, 530.3, 530.4, 541.1, 542.3

[56] References Cited

U.S. PATENT DOCUMENTS

| | | | |
|---|---|---|---|
| 1,838,612 | 12/1931 | Cameron | 242/56.2 |
| 3,157,371 | 11/1964 | Billingsley | 242/56.2 |
| 3,386,679 | 6/1968 | Foulon | 242/56.2 |
| 3,433,429 | 3/1969 | Schnitzspahn | 242/65 |
| 3,712,554 | 1/1973 | Lorenzini et al. | 242/56.9 X |
| 3,792,824 | 2/1974 | Meyer et al. | 242/65 |
| 4,245,796 | 1/1981 | Eglinton | 242/66 |
| 4,767,075 | 8/1988 | Peters et al. | 242/56 A |

FOREIGN PATENT DOCUMENTS

| | | |
|---|---|---|
| 0139272 | 2/1985 | European Pat. Off. . |
| 704163 | 2/1941 | Germany . |
| 2060753 | 12/1970 | Germany . |
| 1499008 | 2/1974 | Germany . |
| 2616891 | 4/1975 | Germany . |
| 2632608 | 2/1977 | Germany . |
| 2933775 | 2/1981 | Germany . |

*Primary Examiner*—John M. Jillions
*Attorney, Agent, or Firm*—Herbert Dubno; Andrew Wilford

[57] ABSTRACT

An apparatus for subdividing a flexible web into at least two strips and winding same up into individual rolls has a supply roll on which the flexible web is wound, at least one takeup roll on which the web is also wound, and a drive for rotating the takeup roll and thereby pulling the web from the supply roll. The supply roll is braked to tension the web. Between the supply and takeup rolls the web is longitudinally slit into at least two individual strips. A pair of pinch rolls between the slitting means and the takeup roll engage the individual strips without slip a drive or brake rotates the pinch rollers at a speed such that the tension in the web upstream of the pinch rollers is substantially greater than the tension downstream of the pinch rollers.

4 Claims, 1 Drawing Sheet

WEB-SLITTING APPARATUS WITH DRIVEN PINCH AND WINDUP ROLLERS FOR VARYING WEB TENSION

CROSS-REFERENCE TO RELATED APPLICATIONS

This is the U.S. national phase of PCT/EP91/00191 filed 01 Feb. 1991 with a claim to the priority of German application P 4,012,979.9 filed 24 Apr. 1990.

1. Field of the Invention

The present invention relates to a method of and apparatus for winding up material webs, in particular cardboard or paper webs, on winding sleeves. More particularly this invention relates to such a system wherein a material web pulled from a supply roll against a braking force is separated by longitudinal cutting into individual strips which are subsequently wound up under tension to individual wound rolls.

2. Background of the Invention

When winding up paper or cardboard webs which are drawn off a supply roll and which are subdivided by longitudinal cutting into individual strips, the webs must be exactly guided through the winding machine and during longitudinal cutting and winding-up must be held under a certain tension. The tension is created by driving the winding roll against a braking force effective on the supply roll, driving of the windup roll being effected by a support or brace roll engaging on its periphery and/or with a guide head connected to a rotary drive engageable in the windup sleeve. Since the tension during winding-up substantially influences the quality of the wound-up roll it is known to control it via the drives of the support or braking rolls or of the guide head and/or of the payout brake of the supply roll.

German published application 3,514,042 describes such a method wherein between the supply roll and the longitudinal-cutting device there are draw rollers and between the draw rollers and the wind roller a web-tension controller is provided. Between the tension rollers and the support roll a stretch control is effective.

German patent 2,060,753 describes a method and apparatus for winding up web-like material on two winding axles which are arranged diametrally opposite each other in a horizontal plane in a support roll. The winding rolls are held on their sleeves by means of retractile guide heads which are fixed in support slides movable radially of the support roll. In this machine the tension is created solely by the support roll braced on the windup roll against the retaining force of the supply roll as it pays out.

It has been shown that the tension of the webs between paying out and rolling up has at best different values depending on the type of paper being used and the necessary winding quality. Thus, on longitudinal, cutting higher tensions are needed much more than for winding up to achieve a tight roll. It can happen that on winding up high tensions are needed for example in core winding by means of a driven guide head of rolls of LWC paper.

OBJECT OF THE INVENTION

It is an object of the invention to so improve such a method and winding machine that different tensions can be set for longitudinal cutting and at the windup location.

SUMMARY OF THE INVENTION

This object is attained according to the invention in a method of the standard type where the web is pulled from a braked supply roll, is longitudinally slit into individual strips, and is then wound up on at least one takeup roll by pinching the individual strips between two pinch rolls at a location the slitter and the takeup roll, and by driving or braking the pinch rolls such that the web is under substantially more tension upstream of the location than downstream therefrom.

By frictionally guiding the webs over a driven roller the tension is subdivided into two stretches of the web, upstream of the driven pinch roll and downstream of the driven roll. The subdivision can be set by the torque applied to the driven roll. Since the interruption of the tension is downstream in the web-travel direction from the longitudinal-cutting device, the longitudinal cutting can be carried out at a substantially higher tension than the winding up. It is particularly advantageous here that the tension necessary for the desired winding quality can be completely independent of the tension requirements in other regions of the path over which the web is guided.

In winding machines with separate drives for each individual winding roll, for instance driven guide heads, according to the invention the tension of each winding roll can be set individually on winding up. Each winding station constitutes an independent winding machine, that is wound rolls of different winding densities can be produced simultaneously from one supply roll.

The freewheeling pinch roll pressed against the roll ensures friction between the web and the driven roller without the web engaging same over a large surface area. The friction can be obtained also by a correspondingly great loop angle around the driven roll. The friction is thus a function of the tension and the conditions in the web (web tension and stretch) are not exactly defined.

The rubber coating of the press roll prevents the formation of marks at the necessary pressure level.

Push rolls formed of individually rotatable segments have the necessary stability even when of small diameter.

In accordance with a particularly advantageous support-roll winding machine according to the invention the driven support roll serves to interrupt the tension. The tension desired for winding up is created by means of the driven guide head which engages the winding sleeves of the winding rolls. This winding machine has the possibility of very large variations on winding since the winding rollers can be driven from the support rollers as well as via the guide heads (normally called a center drive). In addition it is of considerable advantage that the roll pressable on the support roll can be used during a winding roll change as well as to hold the web during cutting as for holding the newly made web end of the run-out web until a new winding sleeve can be installed.

BRIEF DESCRIPTION OF THE DRAWING

The drawing serves to describe the invention with reference to a simplified illustrated embodiment.

SPECIFIC DESCRIPTION

Figure 1:
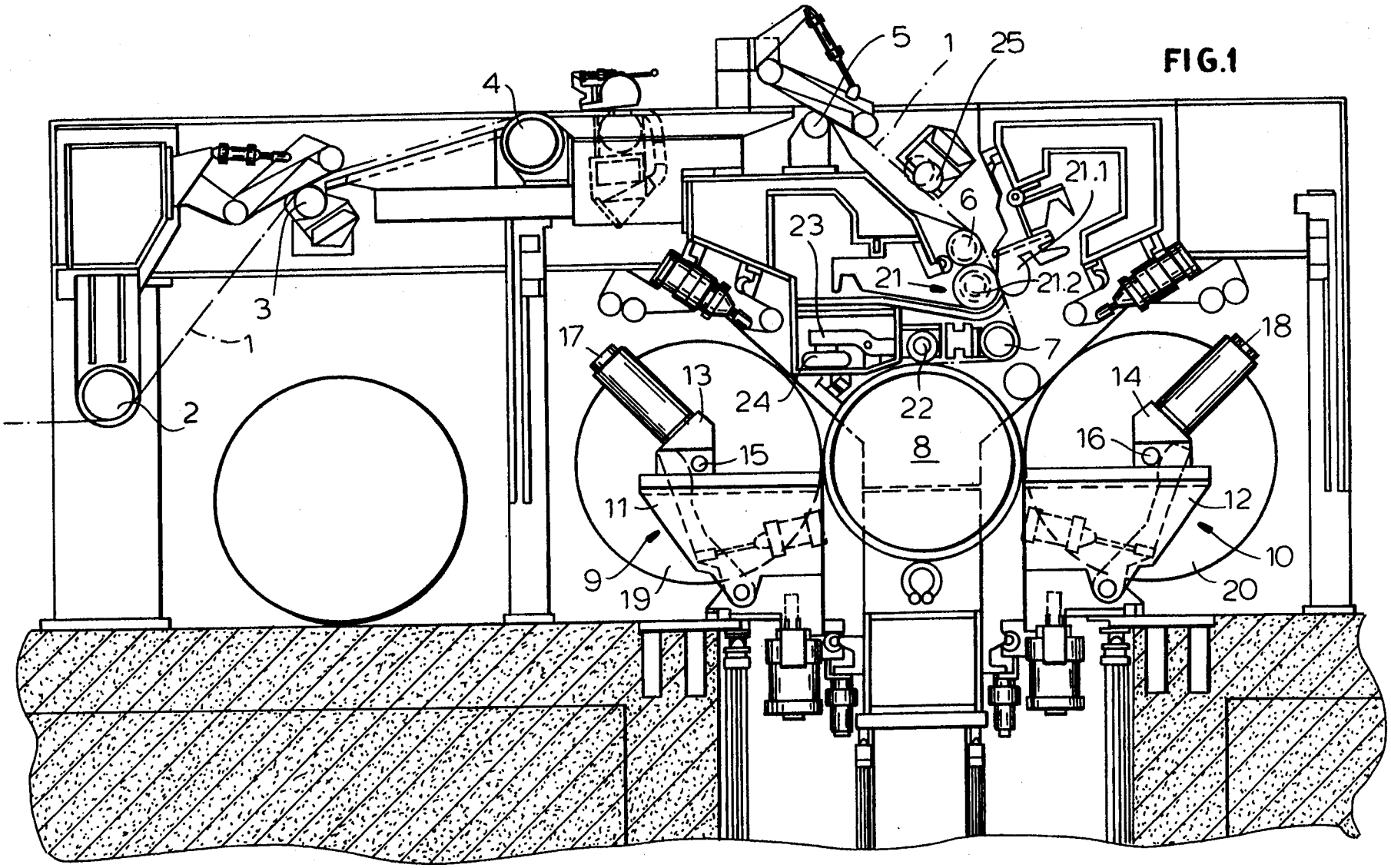
FIG. 1 shows in side view a support-roll winding machine according to the invention.

The material web 1, in this example a paper web, drawn from a not illustrated supply roll is guided by guide rollers 2 through 7 from above to a driven support roll 8. To each side of the support roll 8 are winding stations 9, 10 which are each formed of two winding blocks 11, 12 movable parallel to the support-roll axis. Each winding block 11, 12 carries on its upper side a slide 13, 14 movable radially of the support roll 8 and on which is secured a guide head 15, 16 with its rotary drive 17, 18. The guide heads 15, 16 are movable for holding and driving the support rolls 19, 20 in their winding sleeves.

Between the guide rolls 4 and 5 the web runs on the intake side above the support roll 8 generally horizontally, subsequently it is deflected by the guide roll 5 downward right to the guide roll 7 offset to the vertical centerline through the support roll 8. Between the guide rolls 5 and 6 is a transverse stretching arrangement 25 which guides the web 12 free of folds. In the region between the guide rolls 6 and 7 is a longitudinal cutting device 21 which is comprised of several circular-blade pairs 21.1, 21.2 which are adjustable transversely to the travel direction for different widths of the individual strips to be cut. The guide roll 7 deflects the web 1 generally horizontally and tangentially to the support roll 8 from which it is guided to the adjacent winding stations 9, 10.

Above the support roll 8 is a roll 22 that can be pressed by lateral pivot levers 23 against the support roll 8 in the region engaged by the web 1. In order to press on the support roll 8 and to swing it out of the way to feed in a new web there is a piston/cylinder unit 24 which is supported on the frame of the machine. The roll 22 is comprised of individual but relatively rotatable segments 100 mm to 500 mm long so that it is sufficiently stable even when of small diameter. In order that the paper web is not marked the surface of the roll 22 is rubber covered.

In the described embodiment the support roll 8 serves not only to drive the winding rolls 19, 20 but also as a driven roll in order to coact with the roll 22 to subdivide the tension in the web upstream of the winding stations 9, 10. This is possible because the tension necessary for winding is applied downstream of the pinch location by the drives 17, 18 via the guide heads 15, 16. The support roll 8 can also be braked when the tension must be larger downstream of the pinch location than upstream of the pinch location, that is when the web 1 is pulled off the supply roll. In a winding machine without driven guide heads or without a support roll a separate counter roll is provided in the machine frame for the roll 22 to interrupt the travel of the web. The use of the support roll 8 as a counter roll according to the embodiment of the invention is less expensive to build and has the further advantage that when rolls are changed during and after cutting of the web 1 at the winding stations 9, 10 the newly formed web ends can be clamped with the roll 22 on the support roll 8 and thus held.

On winding, the roll 22 is pressed with an adjustable force against the web 1 lying on the support roll 8. The frictional connection of the web 1 with the support roll 8 creates at the pinch location between the roll 22 and the support roll 8 an interruption of the tension which is created by the rotary drives 17, 18 and by the support roll 8 on the contact line with the rolls 19, 20 against the braked supply roll. Thus the tension can be set at a high level in the region between paying out and pinching as is necessary for a fold-free longitudinal cut with the longitudinal-cutting device 21. The tension at the winding stations 9, 10 is set by the drives 17, 18 to a lesser level necessary for good winding. Thus the tension for each winding roll 19, 20 can be adjusted individually via the respective drives 17, 18. Each winding station thus can be driven as an independent winding machine.

We claim:

1. An apparatus for subdividing a flexible paper web into at least two strips and winding same up into individual rolls, the apparatus comprising:

a supply roll on which the flexible web is wound;

at least two takeup rolls on which the web is also wound;

respective drives each including a support movable generally radially of a main axis, a pair of heads movable on the support toward and away from each other along and rotatable about a takeup axis generally parallel to the main axis, each takeup roll being engaged between a respective one of the pairs of the heads, means for rotating the heads at respective individually variable and different speeds about the respective takeup axes and thereby pulling the web from the supply roll;

means between the supply and takeup rolls for longitudinally slitting the web into at least two individual strips of different widths and for feeding each of the strips to a respective one of the takeup rolls to be wound up on same;

a pair of pinch rollers one of which is freewheeling between the slitting means and the takeup rolls and engaging the individual strips without slip;

drive means for rotating the other pinch roller at a predetermined speed; and brake means connected to the supply roll for resisting rotation of the supply roll and thereby tensioning the web upstream of the pinch rollers such that the tension in the web upstream of the pinch rollers is substantially greater than the tension in the strips downstream of the pinch rollers.

2. The web-slitting apparatus defined in claim 1 wherein the one pinch roll is rubber covered.

3. The web-slitting apparatus defined in claim 1 wherein the one pinch roll is formed by a plurality of cylindrical segments each between 100 mm and 500 mm long.

4. The web-slitting apparatus defined in claim 1 wherein each takeup roll comprises a support movable generally radially of the other pinch roller and carrying a core on which the respective strip is wound up.

* * * * *